US005347904A

United States Patent [19]

Lawrence

[11] Patent Number: 5,347,904

[45] Date of Patent: Sep. 20, 1994

[54] MODULAR GUITAR WITH EASILY REPLACEABLE NECK

[76] Inventor: Barry G. Lawrence, P.O. Box 846, Thomasville, N.C. 27360

[21] Appl. No.: 107,587

[22] Filed: Aug. 18, 1993

[51] Int. Cl.[5] ..... G10D 3/00

[52] U.S. Cl. ..... 84/291; 84/293

[58] Field of Search ..... 84/267, 275, 291, 293

[56] References Cited

U.S. PATENT DOCUMENTS 4,103,583 8/1978 Takabayashi ..... 84/291
4,172,405 10/1979 Kaman, II ..... 84/293
4,295,403 10/1981 Harris ..... 84/293
4,313,362 2/1982 Lieber ..... 84/267
4,432,267 2/1984 Feller ..... 84/293

*Primary Examiner*—Michael L. Gellner
*Assistant Examiner*—Patrick J. Stanzione

[57] ABSTRACT

A guitar is provided with an easily replaceable neck which can be quickly and easily changed for another in the event of damage or for other reasons as desired. The neck is formed from a glass fiber reinforced nylon and includes a neck extension which forms a yoke for releasably bolting to the sound box. The sound box includes a groove for reception of the neck extension to insure correct alignment upon assembly.

15 Claims, 1 Drawing Sheet

MODULAR GUITAR WITH EASILY REPLACEABLE NECK

BACKGROUND OF THE INVENTION

1. Field of the Invention

The invention herein pertains to musical instruments and particularly to stringed instruments which have a sound box and a neck extending therefrom.

2. Description Of The Prior Art and Objectives of the Invention

Traveling musicians and others that play stringed instruments such as guitars often have damage occur to the neck or sound box and must substitute their favorite instrument for an unfamiliar one of the same or lesser quality. Instrument repairmen often take two or more weeks to repair a badly damaged instrument if parts are available and the cost can be quite high. In addition, certain musicians like to change their instruments by substituting one sound box for a sound box of a different color and would like to be able to change the neck of the instrument from time to time to achieve an improved or different tonal output. Instruments such as guitars, banjos and other stringed instruments are conventionally made to generally remain intact and are glued or otherwise permanently assembled except for minor exchangeable components such as strings, bridges and the like.

Thus, with the cost and time consuming efforts required to significantly modify or repair conventional stringed instruments such as guitars or banjos, the present invention was conceived and one of its objectives is to provide a stringed instrument which can be significantly modified, repaired or changed with minimum effort.

It is another objective of the present invention to provide a guitar which has a replaceable neck which can be exchanged in a matter of minutes by a relatively unskilled person using ordinary hand tools at very little cost.

It is still another objective of the present invention to provide a guitar structure which has superior tonal qualities and which can be disassembled and reassembled with little effort or training.

Various other objectives and advantages of the present invention will become apparent to those skilled in the art as a more detailed description is set forth below.

SUMMARY OF THE INVENTION

The aforesaid objectives are realized by providing a guitar and particularly an electric guitar having a easily replaceable neck. The neck is attached to a neck extension and fret board such as by gluing or may be integrally molded which components together form a yoke for reception of the sound box. The neck extension is releasably joined to the sound box by a plurality of bolts which can be quickly aligned and tightened. The guitar neck and neck extension are formed from a glass fiber filled nylon such as by conventional molding techniques and the neck includes a conventional truss rod which can be adjusted to a particular stiffness as desired by the musician.

The sound box is likewise molded from a synthetic polymer plastic such as nylon or polystyrene in a variety of colors and along the back of the sound box a neck extension groove is provided which terminates into a bridge support aperture. The guitar can be easily assembled and disassembled by unskilled persons and the construction will allow the neck and sound box to be quickly changed and properly aligned in the event of damage to one part or for other reasons as desired.

DESCRIPTION OF THE PREFERRED EMBODIMENT

Figures 1, 2, 3, 4:
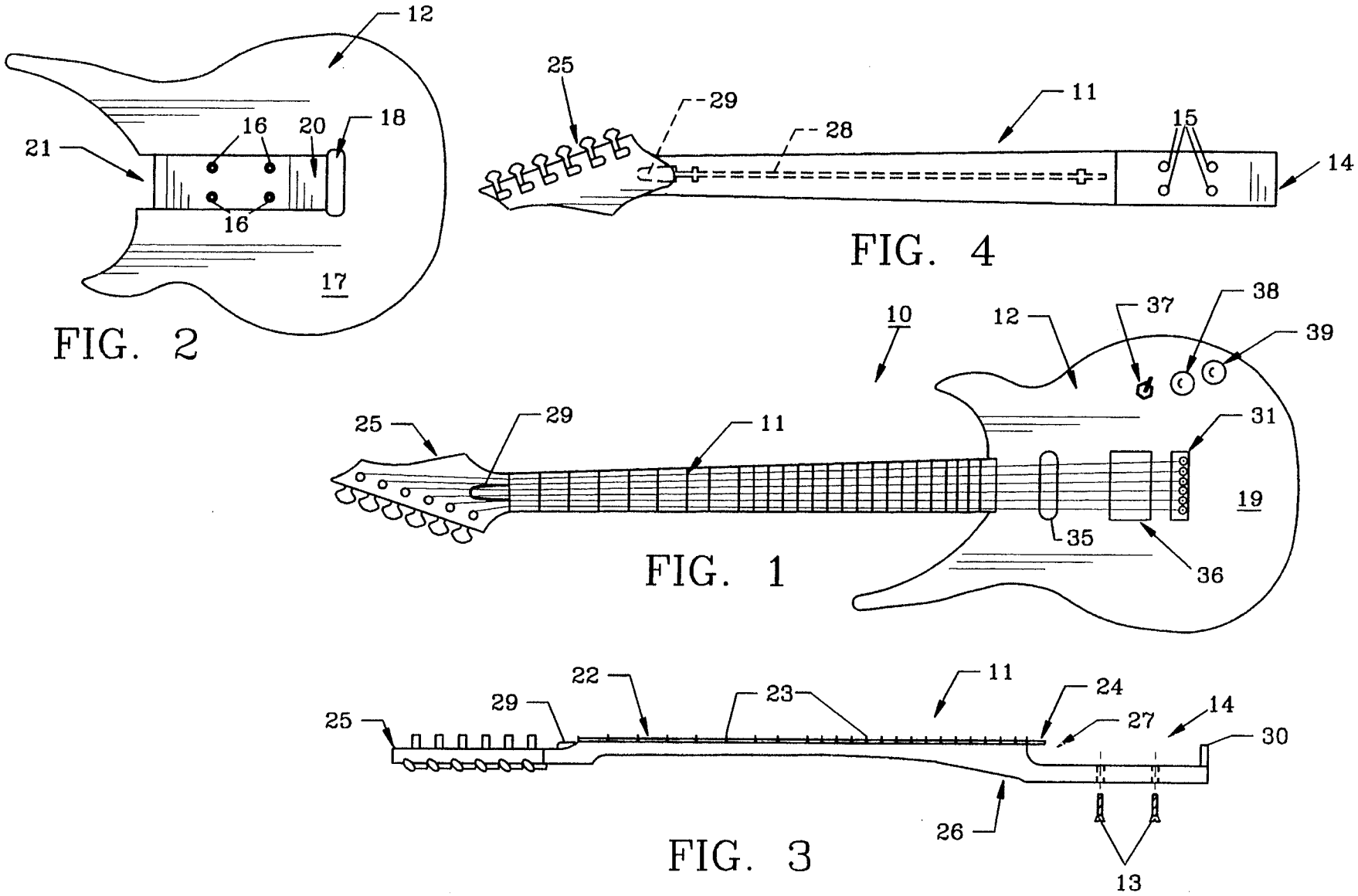
FIG. 1 demonstrates a front elevational view of a guitar of the invention.
FIG. 2 pictures a rear view of the sound box of the guitar as shown in FIG. 1 with the neck removed therefrom.
FIG. 3 illustrates a side elevational view of the neck and certain of the attached components as shown in FIG. 1.
FIG. 4 depicts a bottom plan view of the neck as shown in FIG. 3 with the adjustable truss rod shown in dashed lines.

The preferred form of the invention is shown in FIGS. 1–4 whereby the neck and neck extension are formed from a molded synthetic glass fiber filled material such as nylon. The sound box is likewise molded from a synthetic material such as nylon or polystyrene. The neck and neck extension can be quickly removed from the sound box and replaced with another as desired by using simple hand tools. The sound box includes a longitudinal groove along the back and a bridge support opening therethrough. Within said longitudinal groove a series of threaded apertures are provided for securing the neck extension to the sound box. Along the top of the neck a conventional fret board is positioned which extends partially above the neck extension, forming a yoke therebetween for reception of the sound box. At the rear of the neck extension a vertical bridge support is provided for positioning within the sound box support bridge aperture for attaching a conventional bridge atop the support, once the bridge support is fully inserted into the aperture.

DETAILED DESCRIPTION OF THE DRAWINGS AND OPERATION OF THE INVENTION

For a better understanding of the invention and its use, turning now to the drawings, FIG. 1 demonstrates in top plan view an electric guitar utilizing the novel structure, although other stringed instruments such as conventional guitars and banjos could likewise be constructed. As shown, guitar 10 comprises neck 11 which is attached through neck extension 14 to sound box 12 by conventional securing means such as bolts 13 as seen in FIG. 3. A plurality of for example, four bolts 13 are inserted through openings 15 in neck extension 14 (FIG. 4) and engage threaded openings 16 in longitudinal neck extension groove 20 of sound box 12 as seen in FIG. 2. As further shown, sound box 12 defines bridge support opening 18 which extends from sound box front surface 19 through sound box 12 where it meets neck extension groove 20 at rear surface 17 as also seen in FIG. 2. Cut-out 21 is shown at the forward edge of sound box 12 for engagement with yoke 27 illustrated in FIG. 3. Also, neck 11 is shown with neck extension 14 permanently attached or integrally formed therewith as is at the rear end of neck 11, headstock 25 attached at the opposite end. Neck 11 and the joined components are of course seen in FIG. 3 detached from sound box 12. Neck 11 is also joined or molded with fret board 22 which has a series of conventional frets 23 placed therealong. Fret board 22 extends beyond neck 11 at the rear end thereof and slightly overhangs neck extension 14. Thus, the terminal end 24 of fret board 11 and the front end 26 of neck extension 14 provide a yoke 27 for receiving cut-out 21 of sound box 12 to form a stable connection between neck 11 and sound box 12 as neck extension 14 is secured within neck extension groove 20 of sound box 12 by bolts 13 as earlier explained. Neck extension groove 20 is formed with tight tolerances to snugly receive neck extension 14 to insure proper alignment upon assembly.

Neck 11 is formed from a glass fiber reinforced polymeric material such as nylon by conventional molding techniques and includes an adjustable steel or other rigid truss rod 28 therein. Truss rod 28, as in conventional wooden guitar necks can be adjusted by knob 29 which is exposed proximate headstock 25.

It is often desireable for a musician to change the neck or sound box of a guitar for any of a variety of reasons. Oftentimes, necks or sound boxes are damaged and repairs can take weeks to complete. It has been found that the present invention will provide convenience to the user since the neck or sound box can be changed in a matter of minutes at far less expense than repairing conventional guitars. No special tools are needed and with a few adjustments and tuning steps, the guitar is ready to be played after a neck or sound box has been changed.

To assemble guitar 10 as shown in FIG. 1, sound box cut-out 21 is positioned against yoke 27 of neck extension 14. Bridge support 30 is aligned with bridge support opening 18 on back surface 17 of sound box 12 and neck extension 14 is then urged into neck extension groove 20. Bolts 13 as shown in FIG. 3 are then tightened through neck extension opening 15 (FIG. 4) into threaded openings 16 located in neck extension groove 20 (FIG. 2). Next, bridge 31 as shown in FIG. 1 is affixed to the top of bridge support 30 with screws (not shown) from front surface 19 of sound box 12. Strings 33 are then connected to bridge 31 and headstock 25. Truss rod 28 can then be adjusted and guitar 10 tuned as conventional. To replace either sound box 12 or neck 11, the steps mentioned above are reversed and in a matter of minutes a new neck or sound box can be in use.

As shown in FIG. 1 guitar 10 comprises an electric guitar having a conventional front pick-up 35, rear pick-up 36, on/off switch 37 and volume control knobs 38 and 39. Other conventional components such as a shoulder support strap, electrical wires, speakers and the like are not pictured herein but would be used as required and understood by those skilled in the art.

The illustrations and examples provided herein are for explanatory purposes and are not intended to limit the scope of the appended claims to the exact embodiments or instrument shown.

I claim:

1. A guitar having a replaceable neck for attachment to the sound box comprising: a sound box having a front and a back surface, said back surface defining a neck extension groove, said sound box defining a bridge support aperture, said bridge support aperture extending from said front surface directly to said neck extension groove to provide communication therewith, a neck extension, said extension for releasable reception by said neck extension groove.

2. The guitar of claim 1 and including a bridge support, said bridge support attached to said neck extension.

3. The guitar of claim 1 and including a fret board, said fret board attached to said neck.

4. The guitar of claim 3 wherein said fret board extends beyond said neck over said neck extension.

5. The guitar of claim 1 and including an adjustable neck truss rod, said truss rod contained within said neck.

6. The guitar of claim 1 wherein said neck comprises a fiberglass filled nylon composition.

7. The guitar of claim 1 and including means to secure said neck to said soundboard, said securing means attached to said neck extension.

8. The guitar of claim 2 wherein said bridge support is positioned vertically on said neck extension for reception within said bridge support aperture.

9. An electric guitar having a replaceable neck for attachment to a sound box comprising: a sound box having a front and a back surface, said back surface defining a longitudinally positioned neck extension groove, said sound box defining a bridge support aperture, said bridge support aperture comprising an opening from said front surface of said sound box to said neck extension groove for communication therewith, a neck extension, said extension joined to said neck, a fret board, said fret board attached to said neck and having a length greater than said neck, said fret board and said neck extension defining a yoke for engagement with said sound box, a bridge support, said bridge support attached to said neck extension for reception within said bridge support aperture, means for attaching said neck to said sound box, said attaching means positioned through said neck extension whereby said attaching means can be removed and said neck replaced with another neck on said sound box.

10. The electric guitar of claim 9 wherein said attaching means comprises threaded bolts.

11. The electric guitar of claim 9 wherein said neck is formed from a reinforced synthetic plastic.

12. The electric guitar of claim 9 wherein said neck is molded.

13. The electric guitar of claim 9 wherein said sound box comprises a molded synthetic plastic.

14. The electric guitar of claim 9 and including a sound pick-up, said pick-up attached to said sound box.

15. The electric guitar of claim 9 wherein said neck includes an adjustable truss rod.

* * * * *